US007376048B2

(12) United States Patent
Shiba

(10) Patent No.: US 7,376,048 B2
(45) Date of Patent: May 20, 2008

(54) UNDERWATER SOUND PROJECTOR AND UNDERWATER SOUND PROJECTION METHOD

(75) Inventor: Hiroshi Shiba, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 11/806,891

(22) Filed: Jun. 5, 2007

(65) Prior Publication Data

US 2007/0286026 A1 Dec. 13, 2007

(30) Foreign Application Priority Data

Jun. 9, 2006 (JP) ..... 2006-161464

(51) Int. Cl.
*H04R 1/44* (2006.01)

(52) U.S. Cl. ..... 367/171

(58) Field of Classification Search ..... 367/172, 367/167, 171, 176, 166, 162
See application file for complete search history.

(56) References Cited

U.S. PATENT DOCUMENTS 4,075,600 A * 2/1978 Sims et al. ..... 367/155
4,524,693 A * 6/1985 McMahon et al. ..... 367/167
4,996,675 A * 2/1991 Beauducel ..... 367/167
5,471,721 A * 12/1995 Haertling ..... 427/100
7,187,105 B2 * 3/2007 Shiba ..... 310/325
7,250,706 B2 * 7/2007 Shiba ..... 310/325
2007/0286026 A1 * 12/2007 Shiba ..... 367/171

FOREIGN PATENT DOCUMENTS

JP 10-126877 5/1998
JP 2995509 10/1998

* cited by examiner

*Primary Examiner*—Dan Pihulic
(74) *Attorney, Agent, or Firm*—Young & Thompson

(57) ABSTRACT

Disclosed is an underwater projector projecting a sound underwater. The underwater projector includes a first disk-type resonator unit, a second disk-type resonator unit, and a central space. The second disk-type resonator unit is installed so that a central axis corresponds with that of the first disk-type resonator unit. The central space is set up between the first disk-type resonator unit and the second disk-type resonator unit, and water can enter the central space.

10 Claims, 11 Drawing Sheets

UNDERWATER SOUND PROJECTOR AND UNDERWATER SOUND PROJECTION METHOD

This application is based upon and claims the benefit of priority from Japanese patent application No. 2006-161464, filed on Jun. 9, 2006, the disclosure of which is incorporated herein in its entirety by reference.

BACKGROUND OF THE INVENTION

1. Field of the Invention

The present invention relates to a sound projection technology for projecting a sound. More particularly, the present invention relates to a projection technology for projecting a low-frequency sound.

2. Description of the Related Art

A propagation-loss of the low-frequency sound is less than that of the high-frequency sound underwater. And, a reaching distance of the low-frequency sound is more than that of the high-frequency sound. Therefore, the low-frequency sound is useful for a sound source buoy, a sonar, etc. While a frequency band, referred to as low-frequency, is not defined strictly by experts, it ranges roughly from hundreds Hz to a few KHz in a sector of a sonar system associated with the present invention. A frequency, as is more than 10 KHz, is referred to as a medium frequency or a high frequency.

An underwater projector which can project the low-frequency sound underwater is disclosed by, for example, Japan Patent Laid-Open No. 10-126877 (literature 1) and Japan Patent No. 2985509 (literature 2). The literature 1 discloses an underwater projector by a water column resonance method. This underwater projector projects a sound by causing a medium (water column) inside a cylindrical resonator to resonate.

And, the literature 2 discloses an underwater projector by a bending resonance method. This underwater projector projects a sound by causing a disk-type resonator to bending-resonate.

A low-frequency projector of the literature 1 has such an excellent advantage that it can be used under a very deep water pressure. However, as a projection frequency is lower, the scale of this underwater projector is bigger. When a sound is projected by using a resonance of a water column inside the cylindrical resonator, a sound resonance frequency F is expressed as follows.

$$F=\alpha 1*C/(L+\alpha 2*R) \quad (1)$$

Where C refers to a sound velocity in a medium inside the cylinder, L refers to a cylinder length, R refers to a cylinder radius. $\alpha 1$ and $\alpha 2$ are correction coefficients of a cylindrical shape.

It is apparent from this formula (1) that the cylinder length L and/or the cylinder radius R need to be larger so that the sound resonance frequency F can be lower.

And, the underwater projector of the water column resonance method has also such a difficult point that the projection frequency changes depending on a water depth at which the underwater projector is used. This is because the sound velocity in the medium inside the cylinder changes depending on a water depth. This may be also apparent from the formula (1).

This problem can be solved by installing a pressure compensator in the underwater projector, which expands and contracts according to the increase and the decrease of the medium pressure. However, because the installation of the pressure compensator causes an axis length of the underwater projector to be longer, the scale of the underwater projector is larger.

On the other hand, the underwater projector of the literature 2 projects a sound by causing the disk-type resonator to bending-resonate. While this disk-type resonator projects large amplitude of sound, it is small. Thus, considering this point, the underwater projector of the literature 2 is suitable for the underwater projector which projects the low-frequency sound. And, an output sound frequency of this underwater projector does not depend on a water depth.

Next, the underwater projector of the literature 2 will be described according to FIG. 1 and FIG. 2. FIG. 1 illustrates a cross-section oblique perspective view of this underwater projector, and FIG. 2 is a cross-section view illustrating 2-dimensional axial symmetry resonance mode of this underwater projector.

The underwater projector 100 of FIG. 1 provides two disk-type resonators 103. Each disk-type resonators 103 includes an active disk 101 formed from piezoelectric ceramics and a disk 102 which can bend freely as attached on one side of this active disk 101. The two disk-type resonators 103 are placed face-to-face through an o-ring 104 so that the active disk 101 is outside, and the disk 102 is inside. And, the two disk-type resonators 103 and the o-ring 104 are covered water-tightly by a mold 105.

In the underwater projector 100 configured as above, the two disk-type resonators 103 are driven by driving signals of a same frequency. The driving signals supplied to each of the two disk-type resonators 103 are in an opposite phase each other. Thus, because the two disk-type resonators 103 bending-resonate in an opposite phase each other, this underwater projector 100 projects the low-frequency sound at a high sound pressure in spite of a small scale.

However, this underwater projector 100 of the literature 2 can not be used under a very deep water pressure which is no less than a certain level. The reason is as follows.

The underwater projector 100 of FIG. 1 has an air layer inside. Thus, the water pressure at which this underwater projector 100 is usable is limited within a stress limit of the mold 105. The mold of this underwater projector 100 is stress-destructed if it is placed under a water pressure which is no less than a prescribed value.

While such problem can be solved by installing a pressure compensation mechanism inside, the installation of the pressure compensation mechanism causes the underwater projector 100 itself to be larger.

SUMMARY OF THE INVENTION

A first exemplary aspect of the present invention provides a technology projecting the low-frequency sound although the scale of an apparatus is small.

According to a first exemplary aspect of the present invention, there is provided with the underwater projector which includes the first disk-type resonator unit, the second disk-type resonator unit, and a central space. The second disk-type resonator unit is installed so that a central axis of the second disk-type resonator unit corresponds with that of the first disk-type resonator unit. The central space, to which water can enter, is set up between the first disk-type resonator unit and the second disk-type resonator unit.

In this first exemplary aspect of the present invention, the first disk-type resonator unit is connected in series through the central space to which water can enter. That is, the first exemplary aspect of the present invention does not need the air layer of the technology described in the literature 2. Thus, the first exemplary aspect of the present invention provides an underwater projection technology which is usable under the very deep water pressure without installing the pressure compensation mechanism. This means that the first exemplary aspect of the present invention provides the smaller underwater projector than the underwater projector described in the literature 2.

BRIEF DESCRIPTION OF THE DRAWINGS

The above and other objects, features and advantages of the present invention will become apparent from the following detailed description when taken with the accompanying drawings in which.

DETAILED DESCRIPTION OF THE PREFERRED EMBODIMENTS

Exemplary embodiments of the present invention will be described below according to drawings.

A Disk-Type Resonator

Figure 3:
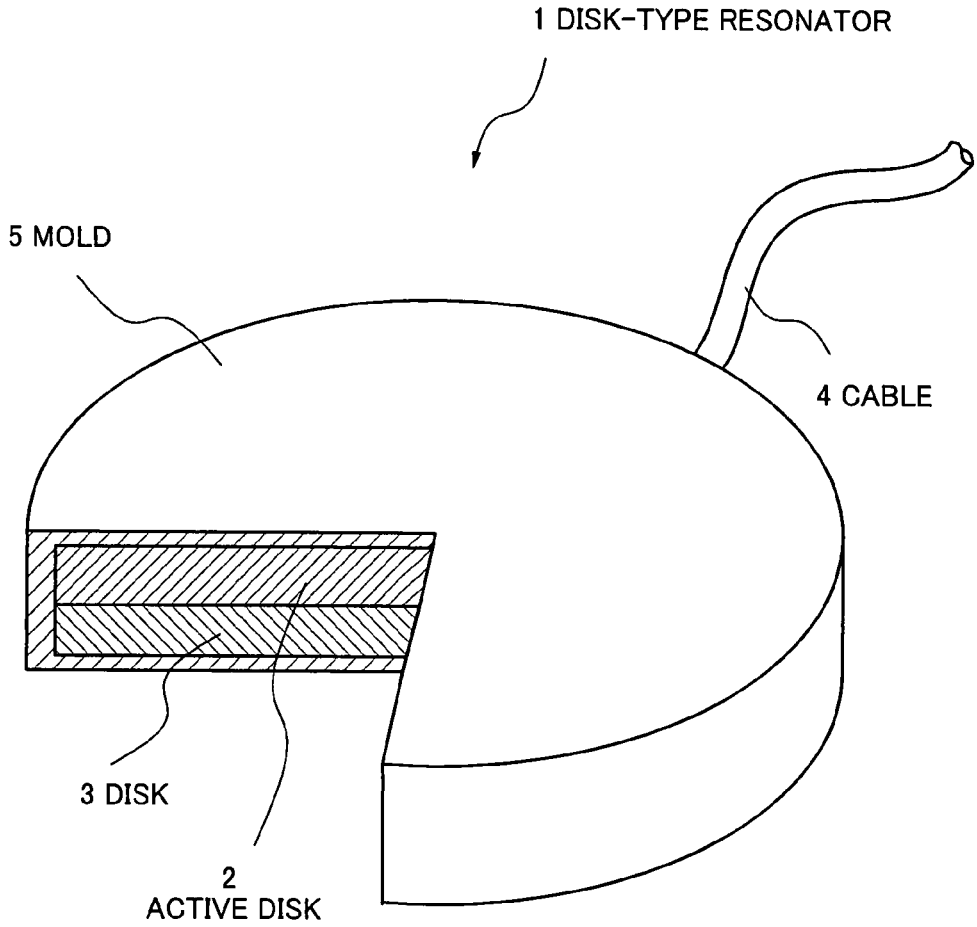
FIG. 3 is a partial cross-section oblique perspective view of the disk-type resonator usable for the underwater projector according to the first exemplary embodiment of the present invention.
Figure 4:
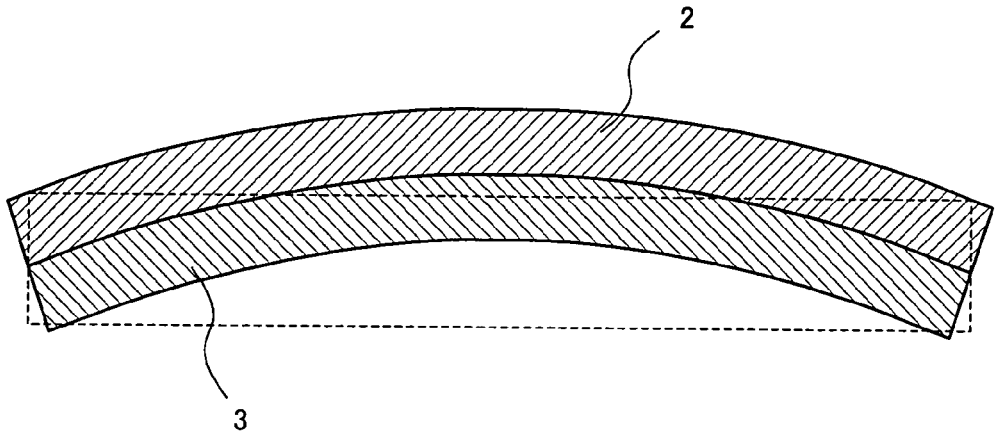
FIG. 4 is a cross-section view illustrating the 2-dimensional axial symmetry resonance mode of the disk-type resonator of FIG. 3.
Figure 5:
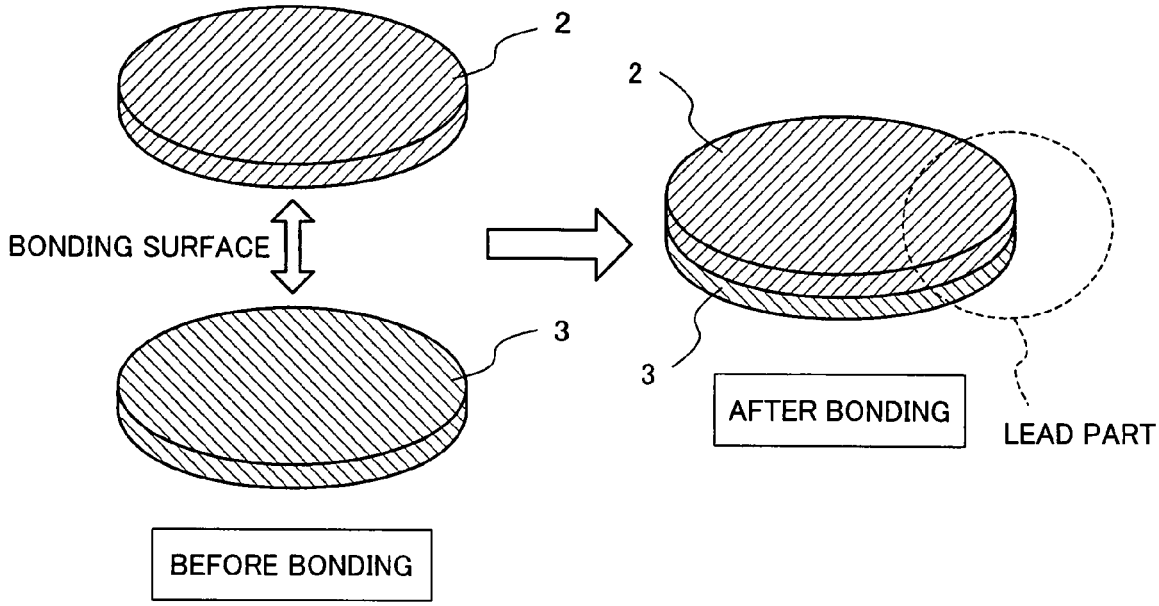
FIG. 5 is a rough oblique perspective view illustrating a manufacturing procedure of the disk-type resonator of FIG. 3.
Figure 6:
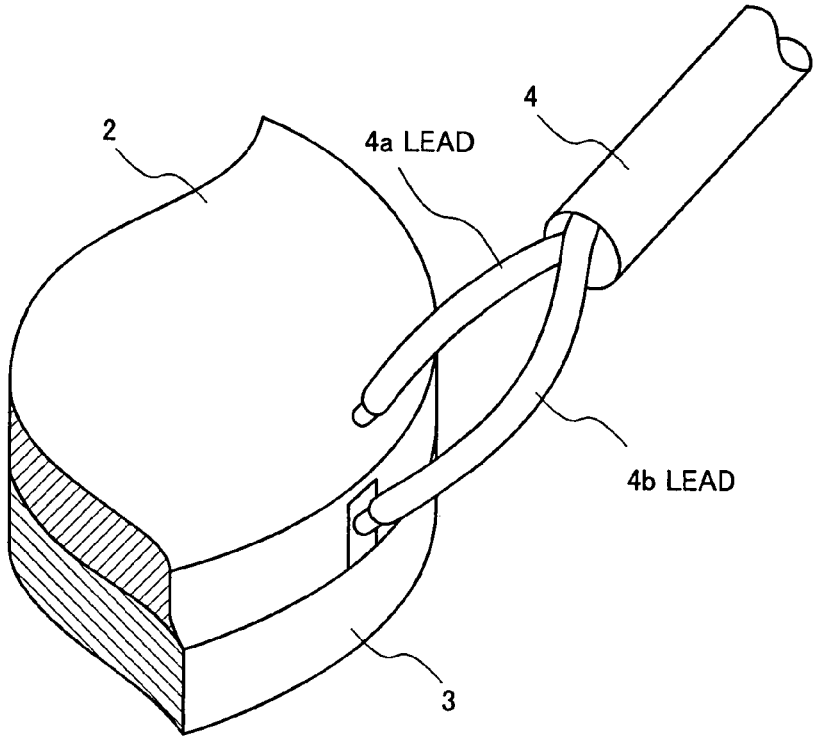
FIG. 6 is a partial oblique perspective view illustrating a connection state between the disk-type resonator and a cable of FIG. 3.
Figure 7:
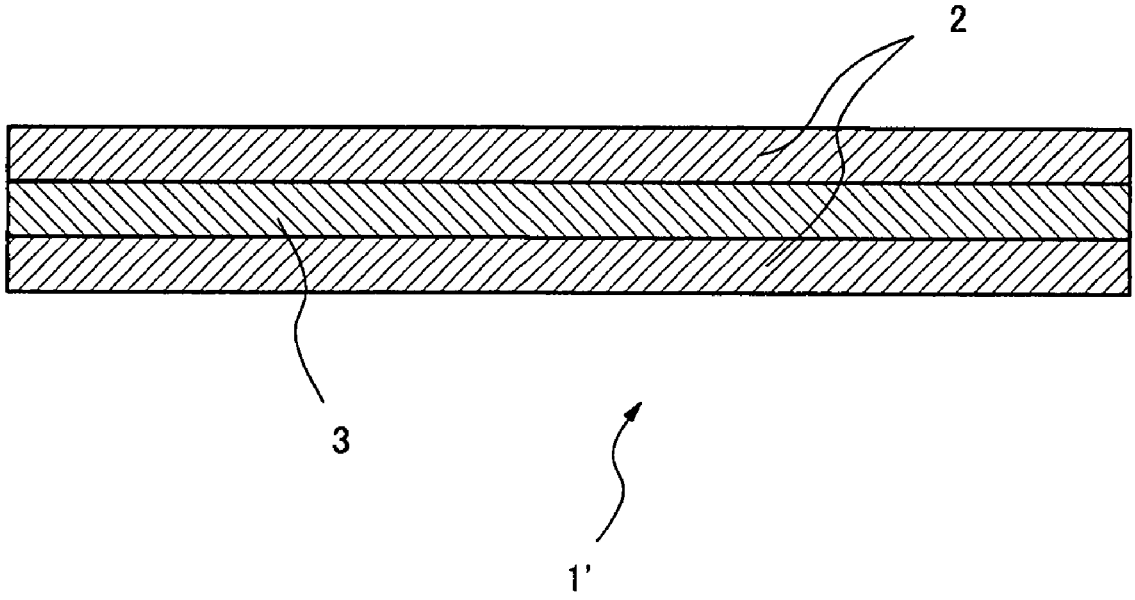
FIG. 7 is a cross-section view illustrating another example of the disk-type resonator usable for the first exemplary embodiment of the present invention.

FIG. 3 is a partial cross-section oblique perspective view of the disk-type resonator usable for the exemplary embodiments of the present invention. FIG. 4 is a cross-section view illustrating the 2-dimensional axial symmetry resonance mode of the disk-type resonator of FIG. 3. FIG. 5 is a rough oblique perspective view illustrating a manufacturing procedure of the disk-type resonator of FIG. 3. FIG. 6 is a partial oblique perspective view of the disk-type resonator usable for the exemplary embodiments of the present invention. FIG. 7 is a cross-section view illustrating another example of the disk-type resonator usable for the exemplary embodiments of the present invention.

As described in such figures, a disk-type resonator 1 usable for the exemplary embodiments of a present invention includes: an active disk 2 formed from the piezoelectric ceramics; a disk 3 which can bend freely, and one side of which this active disk 2 is attached on: a cable 4 connected to the active disk 2; and a mold 5 covering a outside of the active disk 2 and the disk 3. This mold 5 protects the disk-type resonator 1, and ensures the insulation between the disk-type resonator 1 and water.

The disk-type resonator 1 of FIG. 3 and FIG. 6 is a unimorph resonator in which the active disk 2 is attached on one side of the disk 3. The size may be for example, outside diameter 0.23λ, thickness 0.03λ. λ is a wavelength of a frequency used underwater.

In the disk-type resonator 1 configured as above, if a driving signal with a prescribed frequency is applied to the active disk 2 through the cable 4 of FIG. 3, a radial resonance of the active disk 2 is produced. Because the disk 3 is stacked together with the active disk 2, the disk 3 bends passively according to the radial resonance of the active disk 2. Thereby, a bending-resonance mode as described in FIG. 4 is produced in the disk-type resonator 1. In this case, while a sound pressure is projected from the disk-type resonator 1 in a direction of a central axis, a high level sound pressure is not projected by only one disk-type resonator 1 in a direction which is orthogonal to the central axis because the sound pressures of front and back sides of the disk-type resonator 1 are directed in positive and negative directions respectively.

Such disk-type resonator 1 can be manufactured in a procedure described in FIG. 5 and FIG. 6. First, as described in FIG. 5, the active disk 2 is bonded as stacked to the disk 3 by using an epoxy-base adhesive, etc. Next, a lead 4A and a lead 4B of the cable 4 are attached to electrodes of the active disk 2 with soldering, etc. In this case, a front side and a back side (bonding side) of the active disk 2 are set up to be a positive electrode (lead 4A) and a negative electrode (lead 4B) respectively. As described in FIG. 6, the negative electrode may be extracted partially at a side of the active disk 2. Otherwise, the disk 3 is cut out partially, the back side of the active disk 2 is exposed partially, and then the lead 4B may be caused to be connectable to the back side of the active disk 2. After that, an outside of the active disk 2 and the disk 3 is covered with the mold 5. As described above, the disk-type resonator 1 formed with the unimorph resonator is assembled.

Meanwhile, the disk-type resonator 1 illustrated in FIG. 3 to FIG. 6 is the unimorph resonator in which the active disk 2 is attached on one side of the disk 3. However, in preferred embodiments of the present invention, a bimorph resonator (disk-type resonator 1') as illustrated in FIG. 7 can be also used. Meanwhile, the illustration of the mold 5 and the leads is omitted in FIG. 7. In this bimorph resonator, the active disks 2 are attached to both sides of the disk 3. In this case, the disk-type resonator 1' can be assembled in the almost same procedure as described according to FIG. 5 and FIG. 6.

An Underwater Projector (Underwater Projection Method)

Figure 8A:
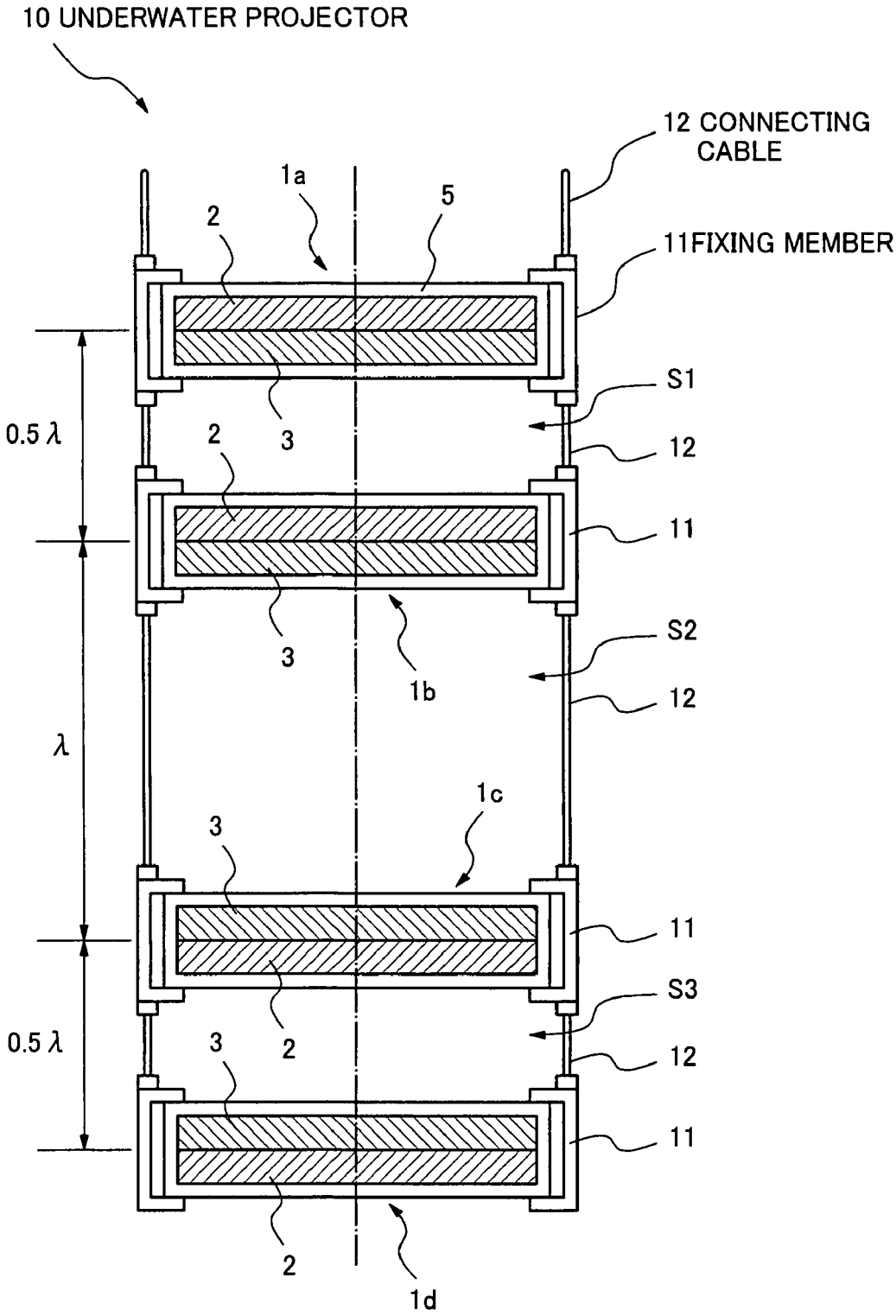
FIG. 8A is a cross-section view of the underwater projector.
Figure 8B:
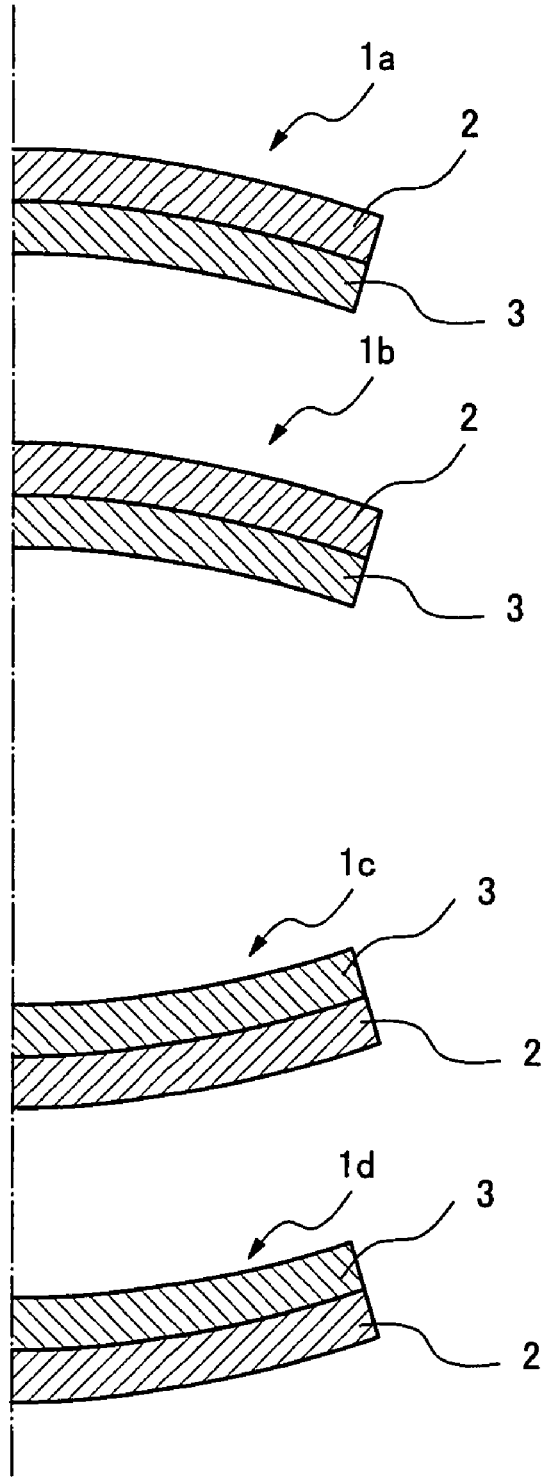
FIG. 8B is a cross-section view illustrating the 2-dimensional axial symmetry resonance mode of the underwater projector of FIG. 8A.
Figure 9:
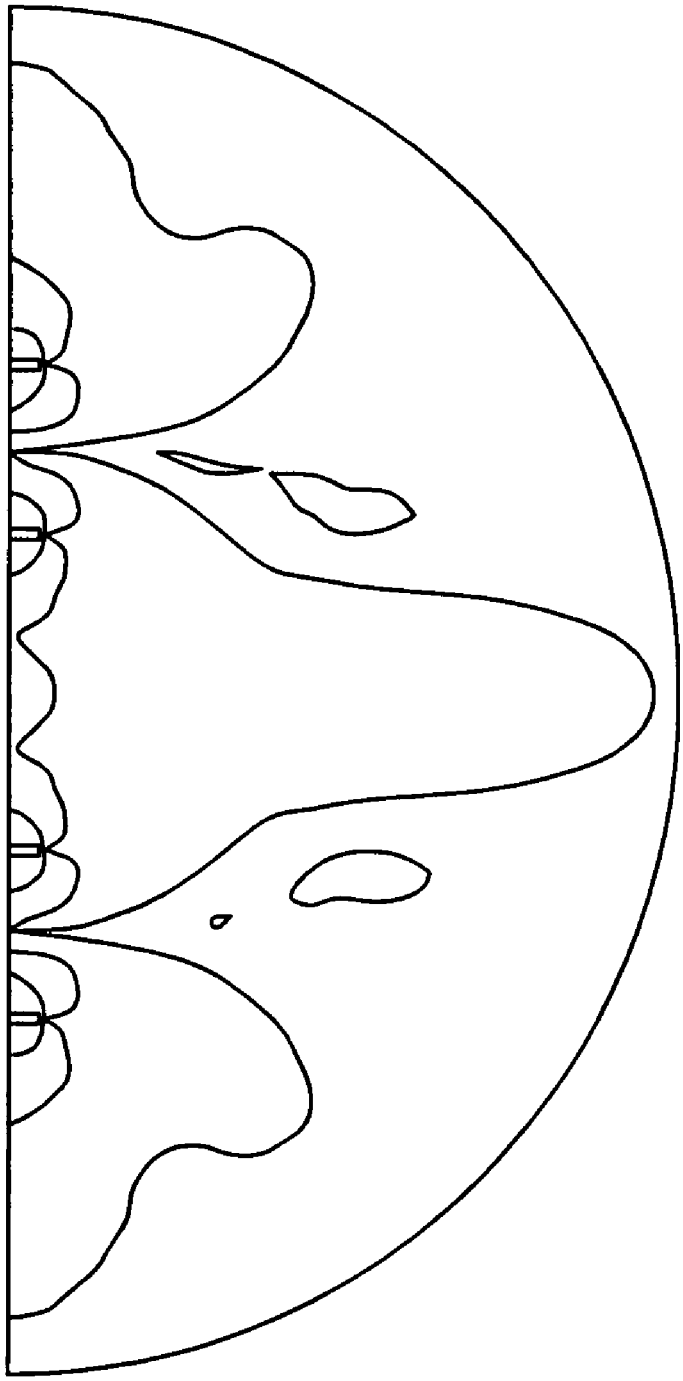
FIG. 9 is a diagram illustrating a sound pressure distribution of the underwater projector of FIG. 8A.
Figure 10:
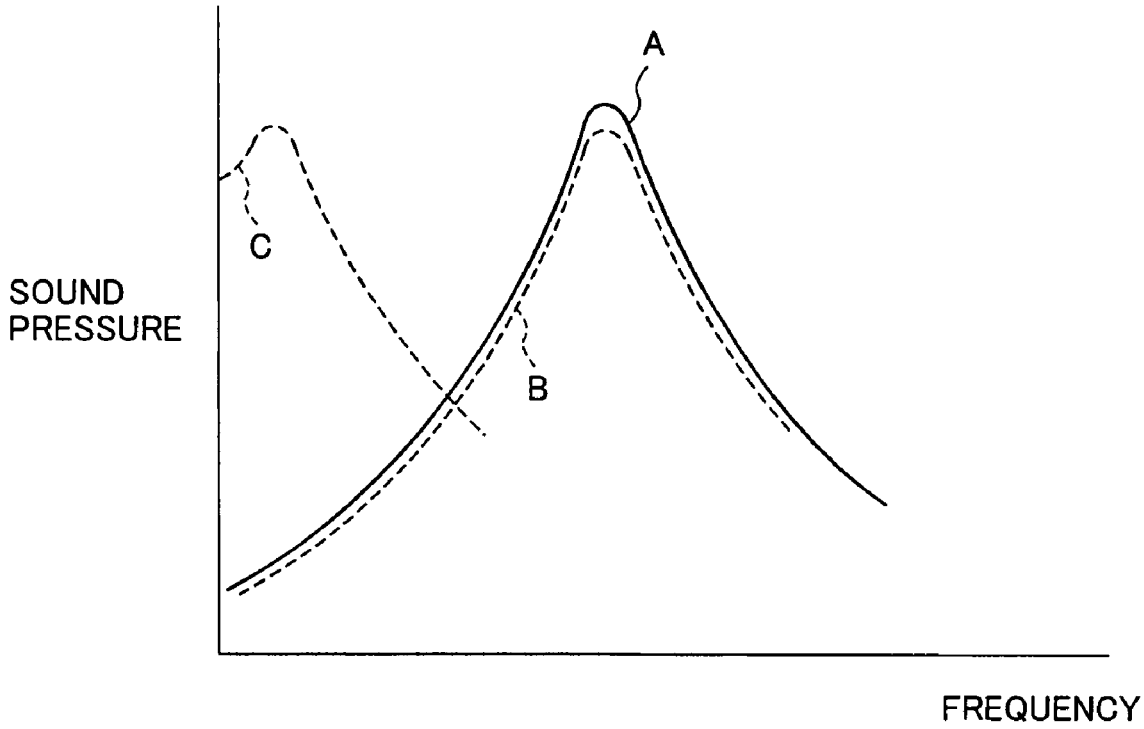
FIG. 10 is a diagram illustrating sound pressure frequency characteristics of the underwater projector of FIG. 8A.

FIG. 8A is a cross-section view of the underwater projector 10 according to the first exemplary embodiment of the present invention, FIG. 8B is a cross-section view illustrating the 2-dimensional axial symmetry resonance mode of the underwater projector 10 of FIG. 8A, FIG. 9 is a diagram illustrating a sound pressure distribution of the underwater projector 10 of FIG. 8A, FIG. 10 is a diagram illustrating sound pressure frequency characteristics of the underwater projector 10 of FIG. 8A.

As illustrated in FIG. 8A, the underwater projector 10 according to the first exemplary embodiment of the present invention provides four disk-type resonators 1*a*, 1*b*B, 1*c*, and 1*d*, and projects a sound underwater with their bending-resonances. In this first exemplary embodiment, there are provided with three spaces S1, S2, and S3 to which water can enter. That is, the space S1 is set up between the disk-type resonators 1*a* and 1*b*. The space S2 is set up between the disk-type resonators 1*b* and 1*c*. The space S3 is set up between the disk-type resonators 1*c* and 1*d*. That is, such disk-type resonators 1*a*, 1*b*, 1*c*, and 1*d* are connected in series in the direction of their central axes through the spaces S1, S2, and S3.

In such configuration, the underwater projector 10 of FIG. 8A is usable under the very deep water pressure. Because plural disk-type resonators 1*a* to 1*d* are connected in series through spaces S1-S3 to which water can enter, the stress-destruction of the disk-type resonator 1 due to the water pressure can be prevented. On the other hand, the underwater projector 100 described according to FIG. 1, as described above, can not prevent the stress-destruction under the very deep water pressure without the pressure compensation mechanism.

And, in the underwater projector 10 of FIG. 8A, the disk-type resonators 1*a* to 1*d* are divided to two groups with the central space S2. Plural disk-type resonators 1 included in each group are configured to be driven by the driving signals of the same frequency, and disk-type resonators of one group bending-resonate in an opposite phase to disk-type resonators of the other group (refer to FIG. 8B).

This underwater projector 10 are configured with two inside disk-type resonators 1*b* and 1*c* which face each other through the central space S2 whose distance is λ, and two outside disk-type resonators 1*a* and 1*d* which are placed parallel through the space S1 and S3 whose distance is 0.5λ outside each inside disk-type resonator respectively.

Figure 1:
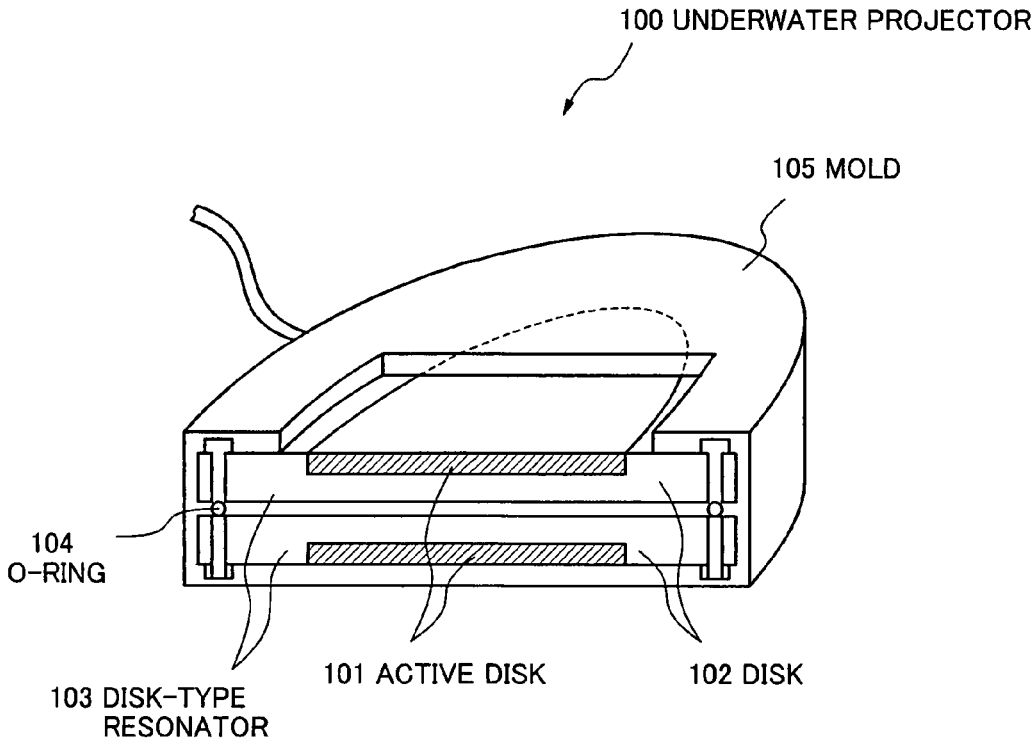
Fig.1 RELATED ART
FIG. 1 is a cross-section oblique perspective view of the underwater projector described in the literature 2.
Figure 2:
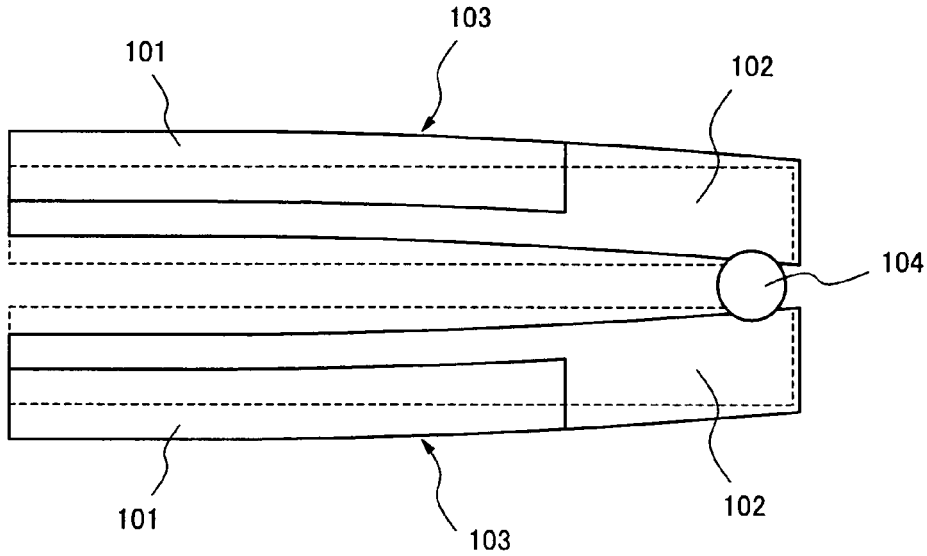
Fig.2 RELATED ART
FIG. 2 is a cross-section view illustrating the 2-dimensional axial symmetry resonance mode of the underwater projector of FIG. 1.

In this configuration, a sound pressure level of a projected sound is increased and its reaching distance is more increased, as compared with the case that a sound is projected underwater by using the two disk-type resonator (i.e., the underwater projector 100 of FIG. 1). Particularly, because an exclusion pressure of an internal medium because of a bending-resonance of the disk-type resonator 1 is concentrated in a central axis orthogonal direction because of the diffraction effect, the sound pressure level in the central axis orthogonal direction is increased. This is apparent from the sound pressure distribution diagram of the 2-dimensional axial symmetry system illustrated in FIG. 9.

And, according to the disk-type resonator 1 of the first exemplary embodiment of the present invention, even if a depth at which the disk-type resonator 1 is used changes, a projection frequency does not change unlike the underwater projector of the water column resonance method, and it is possible to keep a certain projection frequency and a certain or more sound pressure level.

FIG. 10 is a diagram illustrating the sound pressure frequency characteristics of the underwater projector of the water column resonance method of the literature 1 and the underwater projector 10 of the first exemplary embodiment. In FIG. 10, the horizontal axis refers to a projection frequency, and the vertical axis refers to a sound pressure. In FIG. 10, A refers to the sound pressure frequency characteristics of the first exemplary embodiment, B and C refer to the sound pressure frequency characteristics of the underwater projector of the water column resonance method (excepting the case that the pressure compensation mechanism is applied). Meanwhile, the underwater velocity differs by 5% between B and C because of a different depth at which the underwater projector is used. As apparent from FIG. 10, the sound pressure frequency characteristics of the underwater projector of the water column resonance method changes widely depending on a depth at which the underwater projector is used. On the other hand, the sound pressure frequency characteristics of the underwater projector 10 of the first exemplary embodiment do not depend on a depth at which the underwater projector 10 is used.

And, the underwater projector 10 of the first exemplary embodiment of the present invention adopts the unimorph resonator as the four disk-type resonators 1*a* to 1*d*. It is preferable that the unimorph resonator is adopted because this case is lower in cost than the case that the bimorph is adopted.

And, each of such unimorph resonators is placed so that the active disk 2 is directed in a direction of the space S2. That is, the disk-type resonators 1*a* and 1*b* are placed so that the active disks 2 are on an upper in FIG. 8A. And, the disk-type resonators 1*c* and 1*d* are placed so that the active disks 2 are on a lower in FIG. 8A.

According to this placement, even if the driving signals supplied to the disk-type resonators 1*a* and 1*b* and the driving signals supplied to the disk-type resonators 1*c* and 1*d* are same signals, a group of the disk-type resonators 1*a* and 1*b* and a group of the disk-type resonators 1*c* and 1*d* can bending-resonate in an opposite phase each other as illustrated in FIG. 8B.

When the underwater projector 10 is configured as above, as illustrated in FIG. 8A, it is preferable that plural disk-type resonators are connected in series through fixing members 11 which fix and hold the outside, and flexible connecting cables 12 which connect the fixing members 11. There is a following new advantage in this configuration. That is, when this underwater projector 10 is not used, it is possible to store this underwater projector 10 with the plural disk-type resonators which are stacked. Thus, the connecting cables 12 cause a required storing volume to be smaller when this underwater projector 10 is not used.

For example, when a sound pressure level as of a same outside diameter and a same frequency is realized by using the water column resonance method of literature 1, a height size should be 0.28λ. On the other hand, because the underwater projector 10 of FIG. 8A is realized by including four thin disk-type resonators whose thickness is 0.03λ, the height size is 0.12λ for storing, thus, a storing efficiency is improved by 60%.

As described above, the first exemplary embodiment provides the underwater projector 10 of the bending-resonance method which is usable under the very deep water pressure without the pressure compensation mechanism because the plural disk-type resonators are connected in series in the direction of the central axis through the spaces S1, S2, and S3 to which water can enter.

And, in the underwater projector 10 of FIG. 8A, the disk-type resonators 1*a*, 1*b*, 1*c*, and 1*d* are divided to two groups (1A, 1B) and (1C, 1D) in which the central space S2 is a border. The plural disk-type resonators of each group are driven by driving signals of a same frequency and bending-resonate in an opposite phase each other to other group of the disk-type resonators. Meanwhile, if the disk-type resonators of each group, for example, the disk-type resonators 1*a* and 1*b* are caused to resonate in a same phase, a projected sound pressure is increased. It is preferable to maximize this effect that a distance between the disk-type resonators (1A, 1B) and a distance between the disk-type resonators (1C, 1D) are set up to be 0.5λ as described in FIG. 8A. This first exemplary embodiment can increase a projected sound pressure level and increase its reaching distance as compared with the following second exemplary embodiment.

And, in the first exemplary embodiment, the case that the plural disk-type resonators are unimorph resonators can be lower in cost than the case that the bimorph resonators are used because the active disk 2 can be placed outside and the disk 3 can be placed inside. And, because the disk-type resonators facing each other can bending-resonate in opposite phases without inverting phases of the driving signals, a generation circuit of the driving signals is simplified.

And, in the underwater projector 10 of the first exemplary embodiment, because each of the plural disk-type resonators is covered water-tightly with the mold 5, the disk-type resonators are protected from water and sea-water, and the degradation of a projection performance due to insulation failure and corrosion is prevented.

And, in the underwater projector 10 of the first exemplary embodiment, the plural disk-type resonators can be connected in series through the fixing members 11 which fix and hold the outside, and the flexible connecting cables 12 which connect the fixing members 11. When this underwater projector 10 is not used, it is possible to store this underwater projector 10 with the plural disk-type resonators which are stacked. Therefore, a required storing volume can be smaller and a storing efficiency can be increased.

The Second Exemplary Embodiment

Next, an underwater projector 20 of the second exemplary embodiment of the present invention will be described according to FIG. 11A, FIG. 11B, and FIG. 12.

However, regarding the component which is same as that of the first exemplary embodiment, the number is same as that of the first exemplary embodiment, and a description of the first exemplary embodiment is utilized.

Figure 11A:
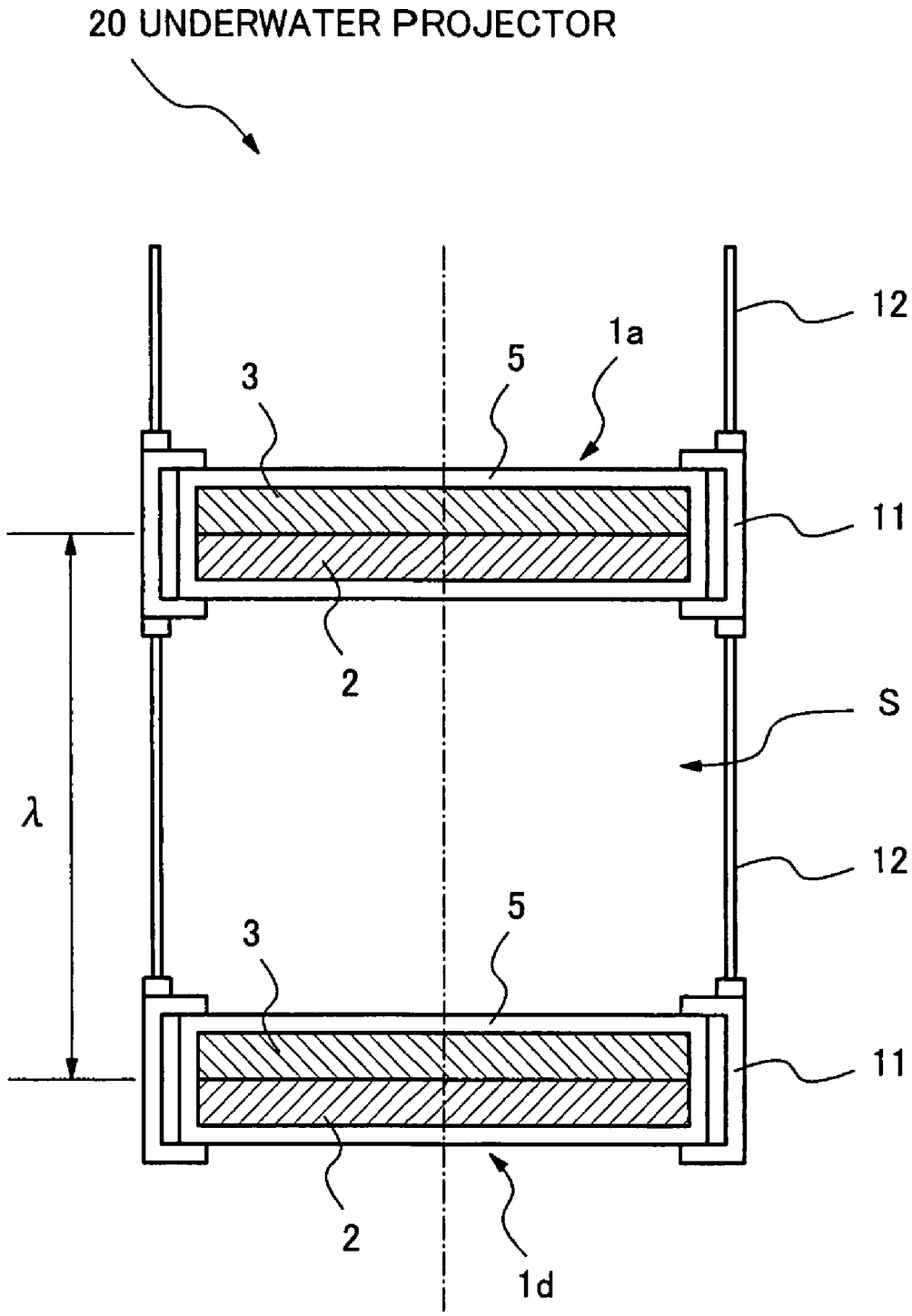
FIG. 11A is a cross-section view of the underwater projector according to the second exemplary embodiment of the present invention.
Figure 11B:
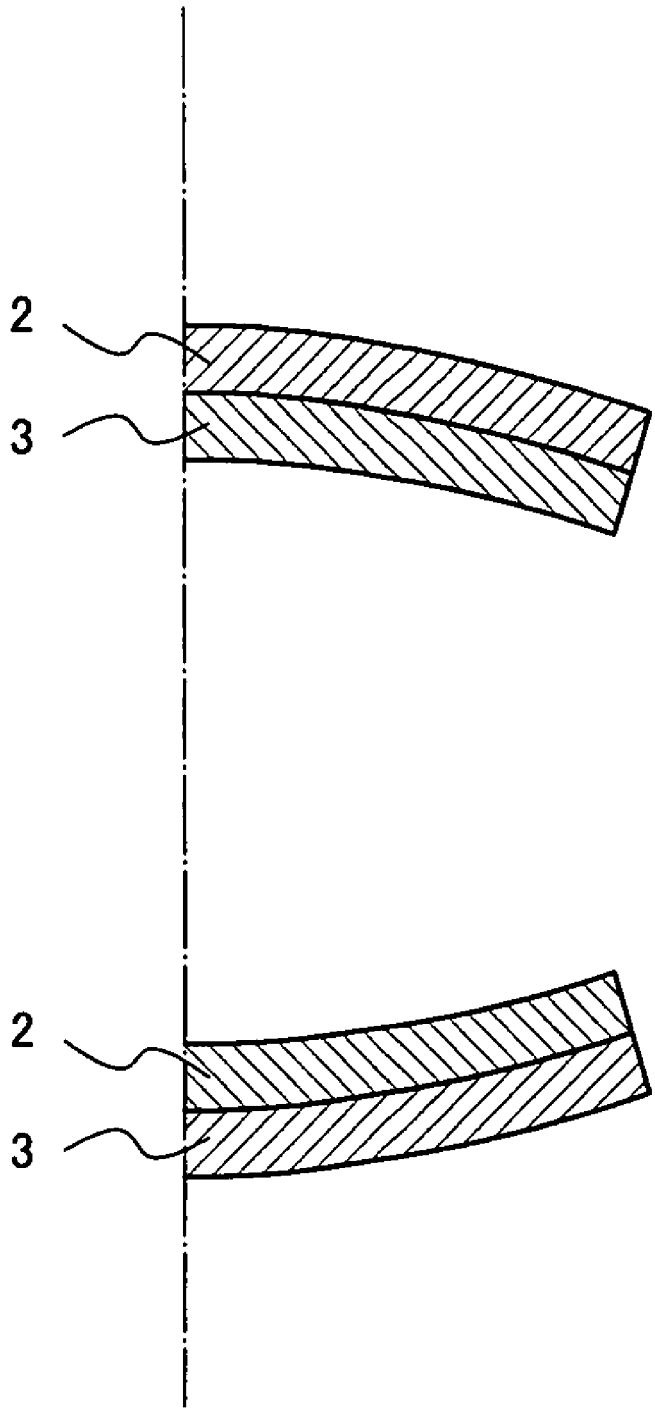
FIG. 11B is a cross-section view illustrating the 2-dimensional axial symmetry resonance mode of the underwater projector of FIG. 11A.
Figure 12:
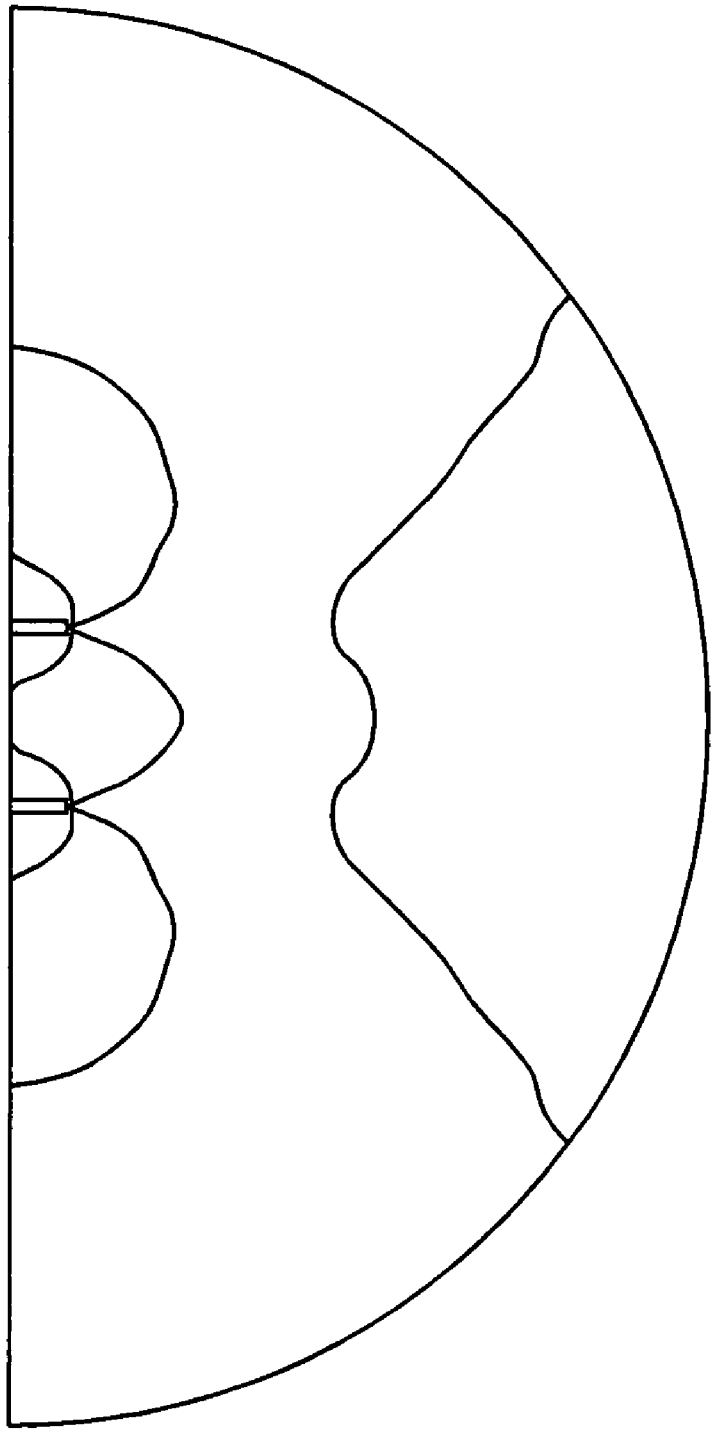
FIG. 12 is a diagram illustrating a sound pressure distribution of the underwater projector of FIG. 11A.

FIG. 11A is a cross-section view of an underwater projector according to the second exemplary embodiment of the present invention, FIG. 11B is a cross-section view illustrating a 2-dimensional axial symmetry resonance mode of the underwater projector according to the second exemplary embodiment of the present invention, and FIG. 12 is a sound pressure distribution of the underwater projector according to the second exemplary embodiment of the present invention.

As described in such figures, the underwater projector 20 of the second exemplary embodiment is different from that of the first exemplary embodiment in a fact that it is configured with two disk-type resonators 1*a* and 1*d*.

Specifically, the two disk-type resonators 1*a* and 1*d*, the unimorph resonators, are configured as connected in series in a direction of the central axis through a space S so that the active disk 2 is outside, and the disk 3 is inside. This space S is an open space to which water can enter. In this case, the two disk-type resonators 1*a* and 1*d* are placed through a predetermined distance (e.g., distance of λ) with the fixing members 11 and the connecting cables 12 as the first exemplary embodiment.

In the underwater projector 20 of FIG. 11, if the driving signals of a same frequency are applied to the two disk-type resonators 1*a* and 1*d*, the two disk-type resonators 1*a* and 1*d* which face each other bending-resonate in an opposite phase as illustrated in FIG. 11B. The underwater projector 20 projects a sound underwater. While the sound pressure produced by this bending-resonance has a high value in the direction of the central axis as illustrated in FIG. 12, the sound pressure in the direction of the central axis is lower than the first exemplary embodiment because only the two disk-type resonators can not concentrate an enough exclusion pressure of an internal medium in a central axis orthogonal direction.

While the two exemplary embodiments have been described above, it is apparent that the present invention is not limited to such exemplary embodiments.

For example, the unimorph resonator is used as a disk-type resonator in the above exemplary embodiments. However, the bimorph resonator is also usable as a disk-type resonator in the present invention.

And, in the above exemplary embodiments in which the unimorph resonator is used, the active disk is placed so as to face in an outside direction of the underwater projector. However, in the present invention, the active disk may be placed so as to face in an inside direction of the underwater projector.

While this invention has been described in connection with certain exemplary embodiments, it is to be understood that the subject matter encompassed by way of this invention is not be limited to those specific embodiments. On the contrary, it is intended for the subject matter of the invention to include all alternatives, modifications and equivalents as can be included with the spirit and scope of the following claims. Further, the inventor's intent is to retain all equivalents even if the claims are amended during prosecution.

What is claimed is:

1. An underwater projector projecting a sound underwater, comprising:

a first disk-type resonator unit;

a second disk-type resonator unit installed so that a central axis corresponds with the central axis of the first disk-type resonator unit; and a first space installed between the first disk-type resonator unit and the second disk-type resonator unit, to which water can enter, wherein a distance of the first space between the first disk-type resonator unit and the second disk-type resonator unit is equal to one wavelength used underwater.

2. The underwater projector according to claim 1, wherein each of the first and second disk-type resonator units includes at least one unimorph resonator.

3. The underwater projector according to claim 2, wherein:

the unimorph resonator includes an active disk formed from piezoelectric ceramics and a disk one side of which is attached to the active disk; and the unimorph resonator of the upper disk-type resonator unit and the unimorph resonator of the lower disk-type resonator unit are installed so as to face each other.

4. The underwater projector according to claim 3, further comprising:

fixing members attached to a periphery of each of the unimorph resonators; and a flexible connecting cable connecting the fixing members.

5. The underwater projector according to claim 3, wherein each of the unimorph resonators is covered by a mold.

6. The underwater projector according to claim 1, wherein each of the first and second disk-type resonator units includes at least two unimorph resonators, and an installation distance between the at least two unimorph resonators is equal to half the wavelength used underwater.

7. The underwater projector according to claim 1, wherein each of the upper and lower disk-type resonator units is at least one bimorph resonator.

8. An underwater projection method, comprising the steps of:

connecting in a central axis direction disk-type resonators including an active disk formed from piezoelectric ceramics and a disk one side or both side of which is attached to the active disk and which can bend freely;

projecting a sound underwater by causing the disk-type resonators to bending-resonate;

dividing the disk-type resonators into two groups through a central space to which water can enter wherein a distance of the central space between the two groups is equal to one wavelength used underwater;

driving the disk-type resonators with driving signals of a same frequency; and causing the disk-type resonators to bending-resonate.

9. The underwater projection method according to claim 8, further comprising the steps of:

driving the two groups of disk-type resonators with the driving signals of a same frequency; and causing the disk-type resonators belonging to different groups to bending-resonate in an opposite phase each other.

10. The underwater projection method according to claim 9, wherein the disk-type resonators are unimorph resonators in which the active disk is attached on one side of the disk, and are placed so that the active disk is outside and the disk is inside.

* * * * *